US007028452B2

(12) United States Patent
Liao

(10) Patent No.: US 7,028,452 B2
(45) Date of Patent: Apr. 18, 2006

(54) PACKAGING DEVICE FOR FITTING AND HEAT-SHRINKING PACKAGING FILM

(75) Inventor: Benker P. C. Liao, Taipei (TW)

(73) Assignee: Benison & Co., Ltd., Taipei (TW)

( * ) Notice: Subject to any disclaimer, the term of this patent is extended or adjusted under 35 U.S.C. 154(b) by 0 days.

(21) Appl. No.: 10/929,389

(22) Filed: Aug. 31, 2004

(65) Prior Publication Data

US 2006/0042198 A1 Mar. 2, 2006

(51) Int. Cl.
*B65B 53/02* (2006.01)

(52) U.S. Cl. ..... 53/557; 53/567; 53/585; 53/442

(58) Field of Classification Search ..... 53/442, 53/666, 557, 567, 577, 585
See application file for complete search history.

(56) References Cited

U.S. PATENT DOCUMENTS

| | | | | | |
|---|---|---|---|---|---|
| 1,516,497 | A * | 11/1924 | Pierce | 53/577 |
| 1,869,116 | A * | 7/1932 | Rambold | 53/134.2 |
| 3,572,004 | A * | 3/1971 | Carmichael | 53/48.2 |
| 3,664,088 | A * | 5/1972 | Sherman | 53/547 |
| 3,760,968 | A * | 9/1973 | Amberg et al. | 215/12.2 |
| 3,892,059 | A * | 7/1975 | Widigs | 53/452 |
| 3,959,065 | A * | 5/1976 | Ashcroft | 156/423 |
| 4,023,238 | A * | 5/1977 | Phares | 452/37 |
| 4,072,553 | A * | 2/1978 | Braker et al. | 156/423 |
| 4,136,505 | A * | 1/1979 | Putnam et al. | 53/551 |
| 4,445,311 | A * | 5/1984 | Nentwig | 53/575 |
| 4,497,156 | A * | 2/1985 | Scheidegger | 53/399 |
| 4,600,371 | A * | 7/1986 | Fresnel | 425/110 |
| 4,765,121 | A * | 8/1988 | Konstantin et al. | 53/442 |
| 4,806,187 | A * | 2/1989 | Fujisawa | 156/86 |
| 4,947,627 | A * | 8/1990 | Scheidegger | 53/557 |
| 5,027,584 | A * | 7/1991 | McMahon et al. | 53/451 |
| 5,596,914 | A * | 1/1997 | Liao | 82/70.2 |
| 5,737,900 | A * | 4/1998 | Konstantin et al. | 53/295 |
| 5,822,949 | A * | 10/1998 | Naoi | 53/55 |
| 5,826,404 | A * | 10/1998 | Fuss et al. | 53/459 |
| 5,918,447 | A * | 7/1999 | Hanten et al. | 53/551 |
| 6,016,641 | A * | 1/2000 | Nagano | 53/298 |
| 6,070,399 | A * | 6/2000 | Huang et al. | 53/585 |
| 6,200,249 | B1 * | 3/2001 | Fukuda | 493/186 |
| 6,263,643 | B1 * | 7/2001 | Kovacs et al. | 53/459 |
| 6,651,858 | B1 * | 11/2003 | Shen | 226/176 |
| 6,684,599 | B1 * | 2/2004 | Fresnel | 53/64 |
| 6,832,462 | B1 * | 12/2004 | Peacock et al. | 53/412 |
| 2002/0112451 | A1 * | 8/2002 | Pritchard | 53/451 |
| 2005/0022469 | A1 * | 2/2005 | Fresnel | 53/399 |

* cited by examiner

*Primary Examiner*—Scott A. Smith
*Assistant Examiner*—Gloria R. Weeks
(74) *Attorney, Agent, or Firm*—Rosenberg, Klein & Lee

(57) ABSTRACT

A packaging device includes a film fitting mechanism, a film shrinking mechanism and a controller. The film fitting mechanism fits a tubular heat shrinkage film over a film cylinder and moves the film a distance along the cylinder and cuts a length of the film off. The length of the film is then conveyed to the film shrinking mechanism. The film shrinking mechanism is arranged next to the film fitting mechanism and includes a base for supporting an article to be packed with the film that is cut by the film fitting mechanism and heating units for supplying high temperature air flows to the film thereby making the film shrink and tightly wrap over the article. The controller controls and coordinates the operations between the film fitting mechanism and the film shrinking mechanism.

9 Claims, 7 Drawing Sheets

PACKAGING DEVICE FOR FITTING AND HEAT-SHRINKING PACKAGING FILM

BACKGROUND OF THE INVENTION

1. Field of the Invention

The present invention generally relates to the field of heat-shrinking film packaging, and in particular to a device for both fitting a heat-shrinking film over an article to be packed and heating and shrinking the packaging film with a simplified structure.

2. The Related Art

Plastic packaging films have been widely used to wrap and pack consumer products, such as foods, books, video/audio compact disks for protecting the products from contamination and damage. The film is fit over an article to be packaged and then heated to shrink and thus tightly wrap over the article.

Conventionally, in a large-scale packaging system that employs heat-shrinking film to pack commercial or industrial products, two separate stations are arranged, respectively for fitting a length of a tubular packaging film over each of the products to be packed and for heating and thus shrinking the film tightly over the product. This is because the film fitting and film shrinking operations must be organized in accordance with the a number of parameters, such as the products to be packed, the quantity of the products to be packed in unit time of manufacturing and the manufacturing process of the products. Thus, integration of the fitting and shrinking operations in a single device is not available heretofore, especially for small businesses having limited work space and/or small quantity packaging operation.

Further, the conventional packaging system also suffers the complication of the parts and structure thereof. This makes it hard, and even impossible, to operate the system with a single operator. The packaging system is comprised of at least two stations, respectively for film fitting and film shrinking, requiring separate operators. This increases the overall costs of labor and time consumed in wrapping products. This is anther reason that the conventional packaging system does not fit the need of small-sized businesses and small-scale packaging.

Thus, the present invention is aimed to provide a unitary packaging device that overcomes the drawbacks of the conventional packaging systems.

SUMMARY OF THE INVENTION

A primary objective of the present invention is to provide a packaging device having a simplified structure in which both fitting and shrinking are combined as a unitary device whereby costs and the amount of space occupied by the device are reduced.

Another objective of the present invention is to provide a packaging device capable to perform both film fitting and film shrinking with a simplified structure whereby labor of operator for controlling a packaging process with the packaging device is substantially reduced.

A further objective of the present invention is to provide a packaging device in which film fitting mechanism and film shrinking mechanism are integrated as a unitary device whereby the whole device can be controlled by a single operator and is thus particularly fit for the needs of small business and small quantity packaging purposes.

To achieve the above objectives, in accordance with the present invention, there is provided a packaging device comprises a film fitting mechanism, a film shrinking mechanism and a controller. The film fitting mechanism fits a tubular heat shrinkage film over a film cylinder and moves the film a distance along the cylinder and cuts a length of the film off. The length of the film is then conveyed to the film shrinking mechanism. The film shrinking mechanism is arranged next to the film fitting mechanism and comprises a base for supporting an article to be packed with the film that is cut by the film fitting mechanism and heating units for supplying high temperature air flows to the film thereby making the film shrink and tightly wrap over the article. The controller controls and coordinates the operations between the film fitting mechanism and the film shrinking mechanism.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
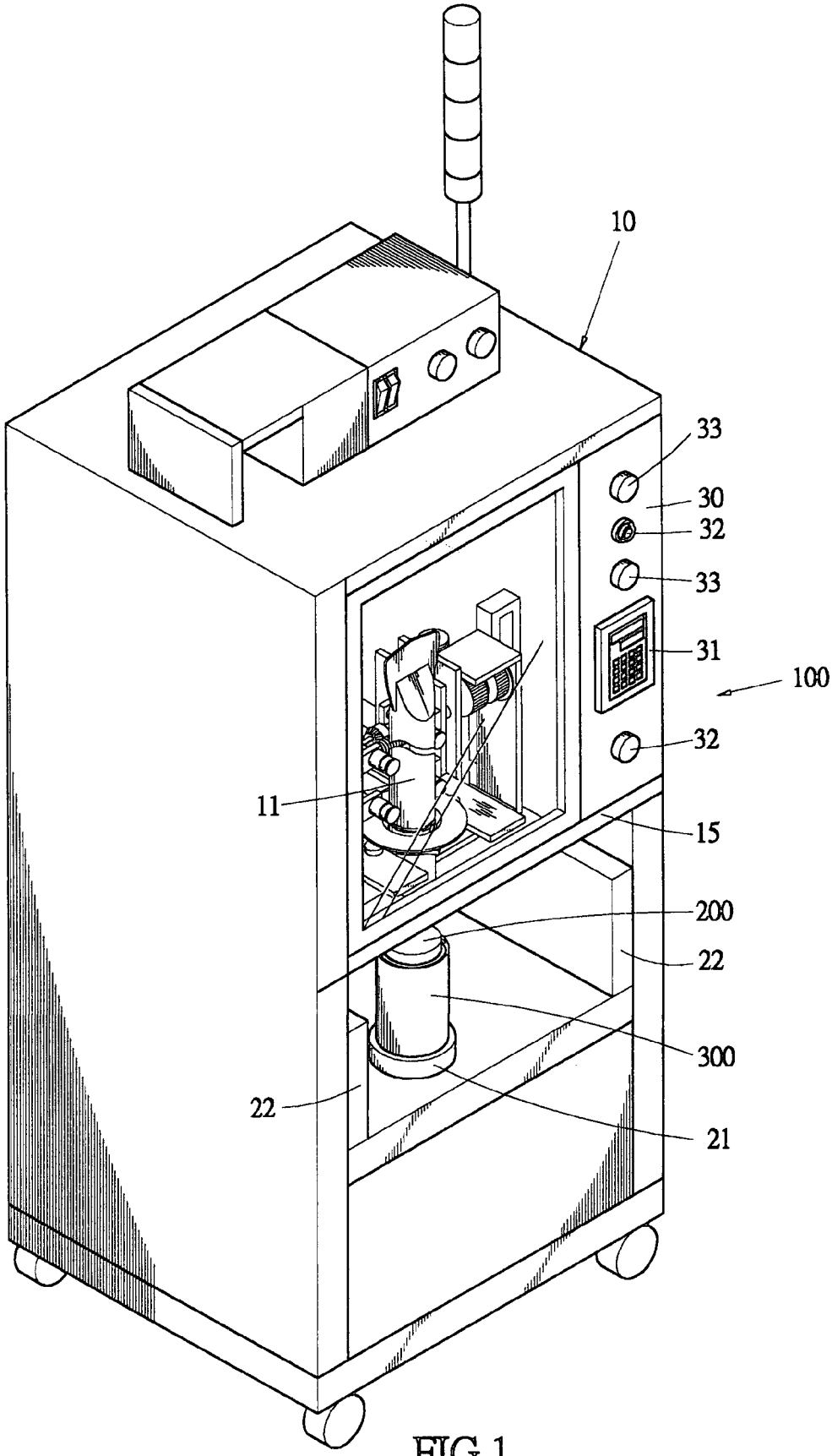
FIG. 1 is a perspective view of a packaging device constructed in accordance with a first embodiment of the present invention.
Figure 2:
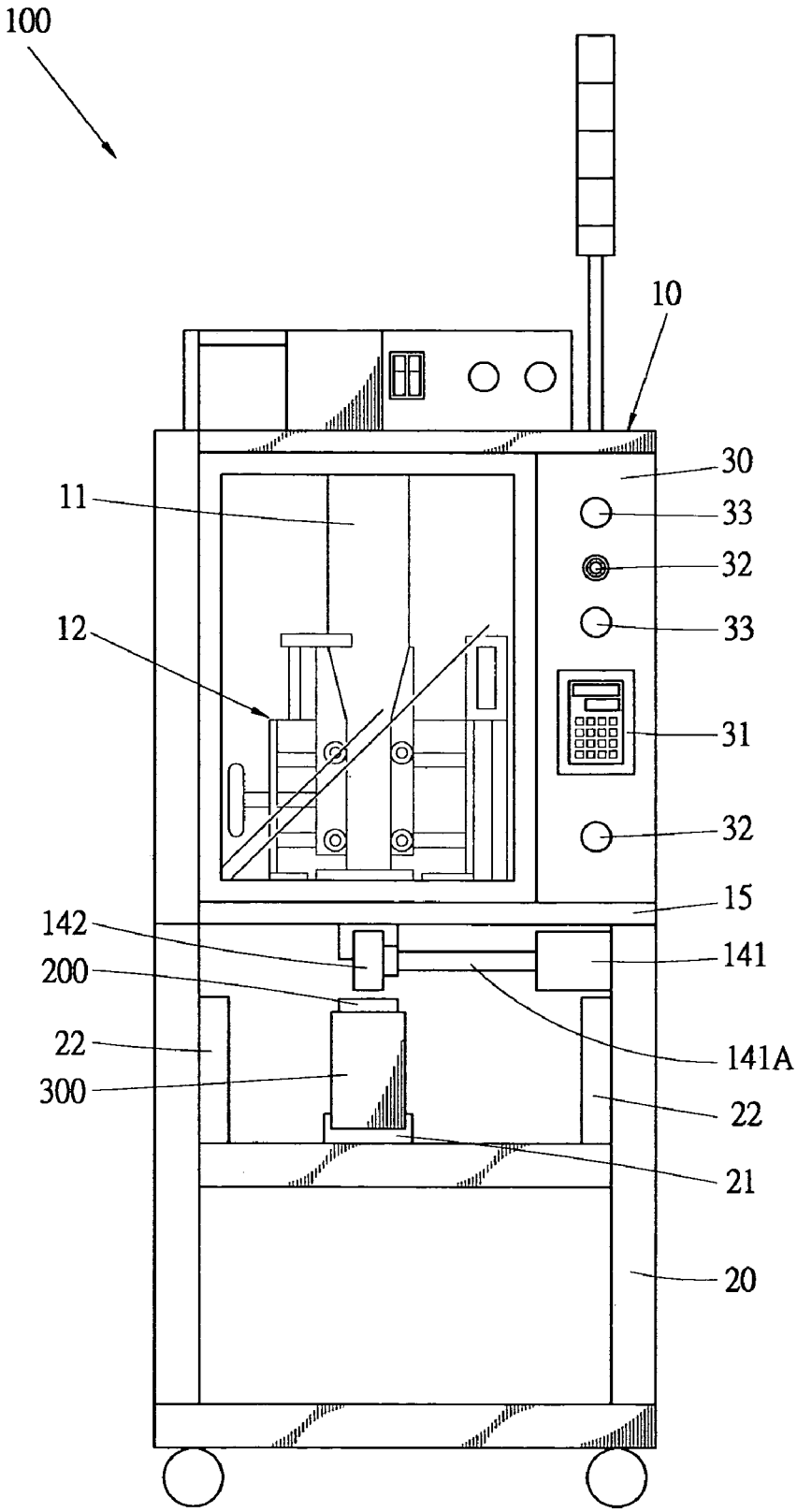
FIG. 2 is a front view of the packaging device illustrated in FIG. 1.

With reference to the drawings and in particular to FIGS. 1 and 2, a packaging device constructed in accordance with the present invention, generally designated with reference numeral 100, comprises a film fitting mechanism 10, a film shrinking mechanism 20, and a controller 30. The film fitting mechanism 10 includes a film cylinder 11, a film feeding device 12, and a film cutting device 13, all arranged in a casing 15, and a film discharge device 14 arranged below the casing 15.

Figure 3:
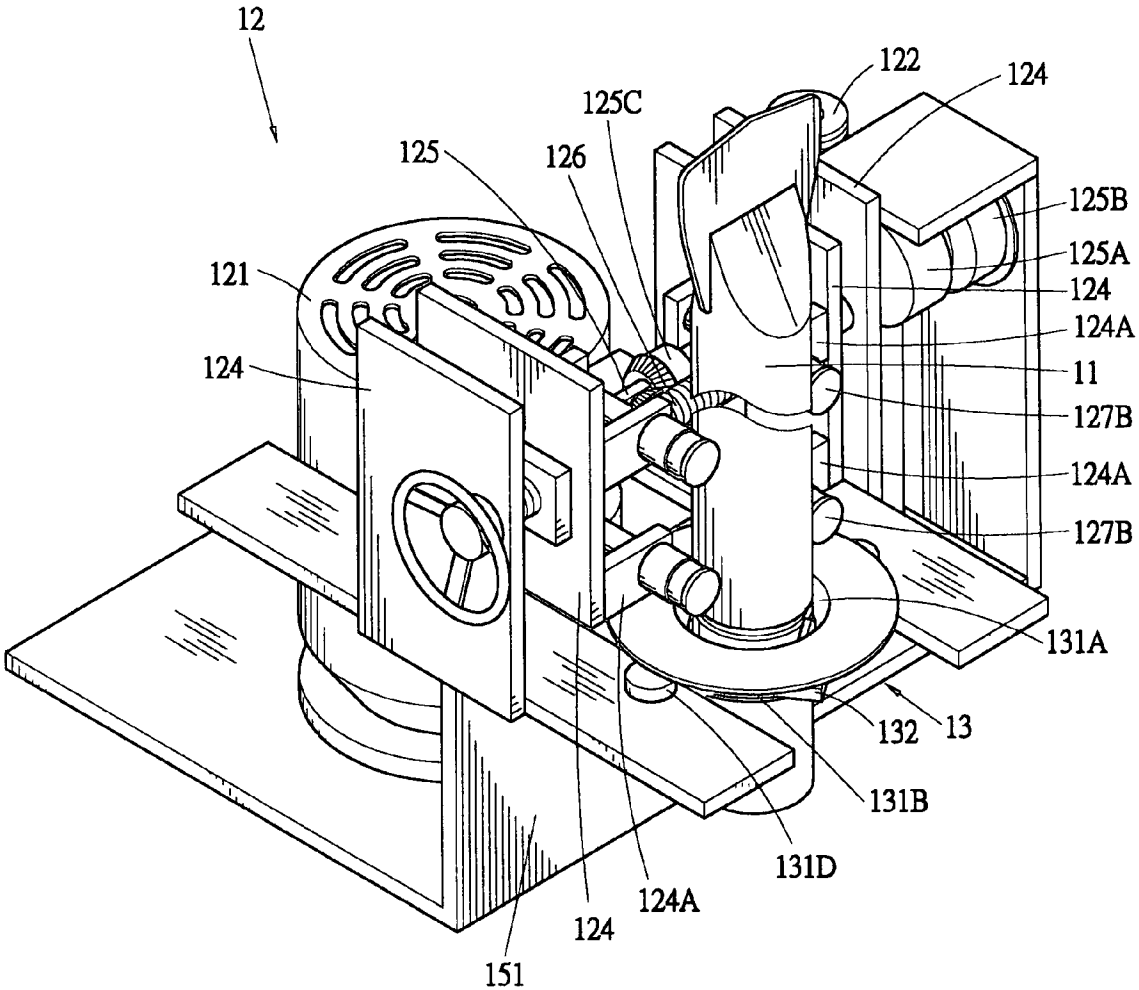
FIG. 3 is a perspective view of a film fitting mechanism of the packaging device, including a film cylinder, a film feeding device, and a film cutting device.
Figure 4:
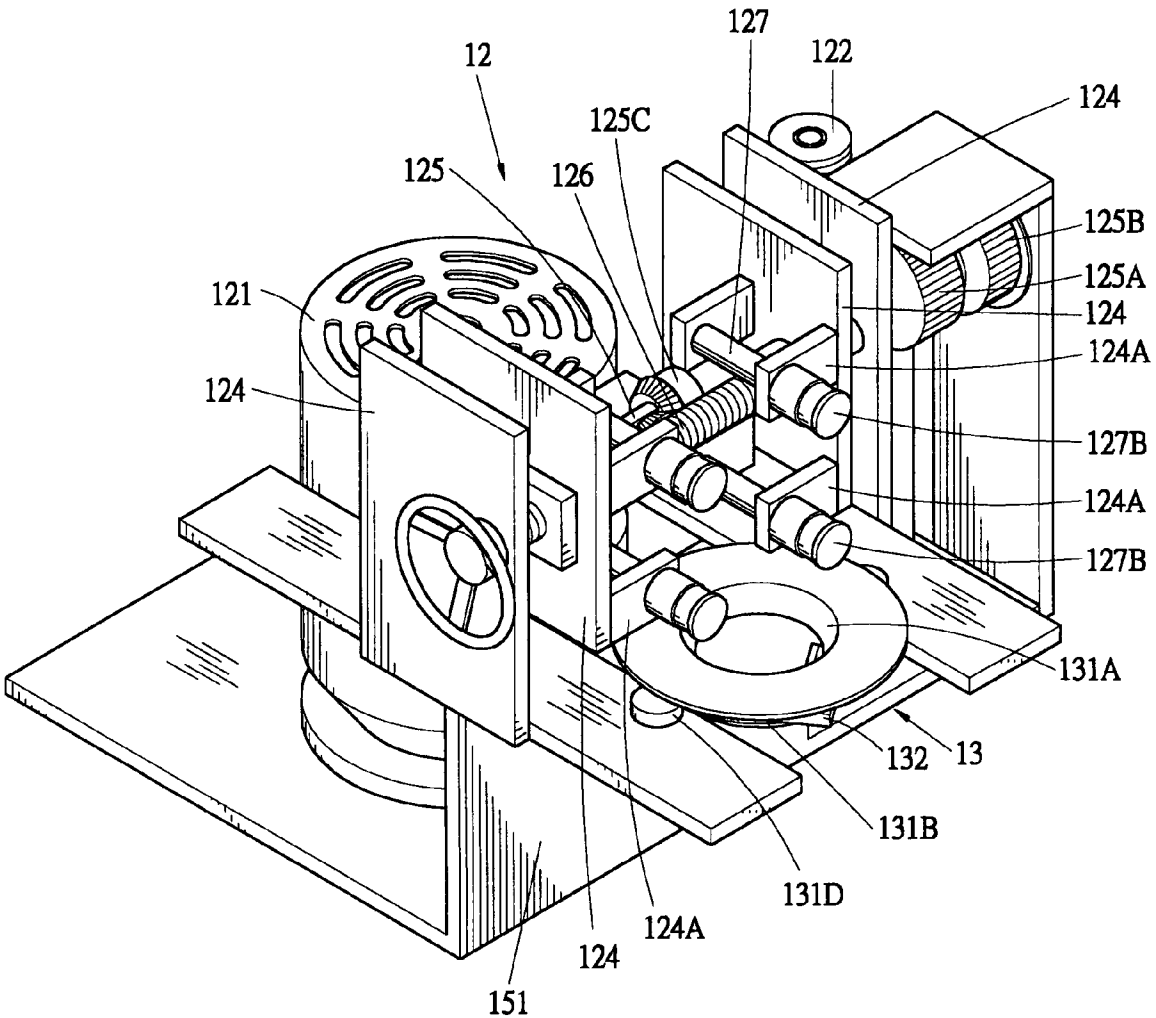
FIG. 4 is a perspective view similar to FIG. 3, with the film cylinder removed to show a film cutter of the film cutting device.
Figure 5:
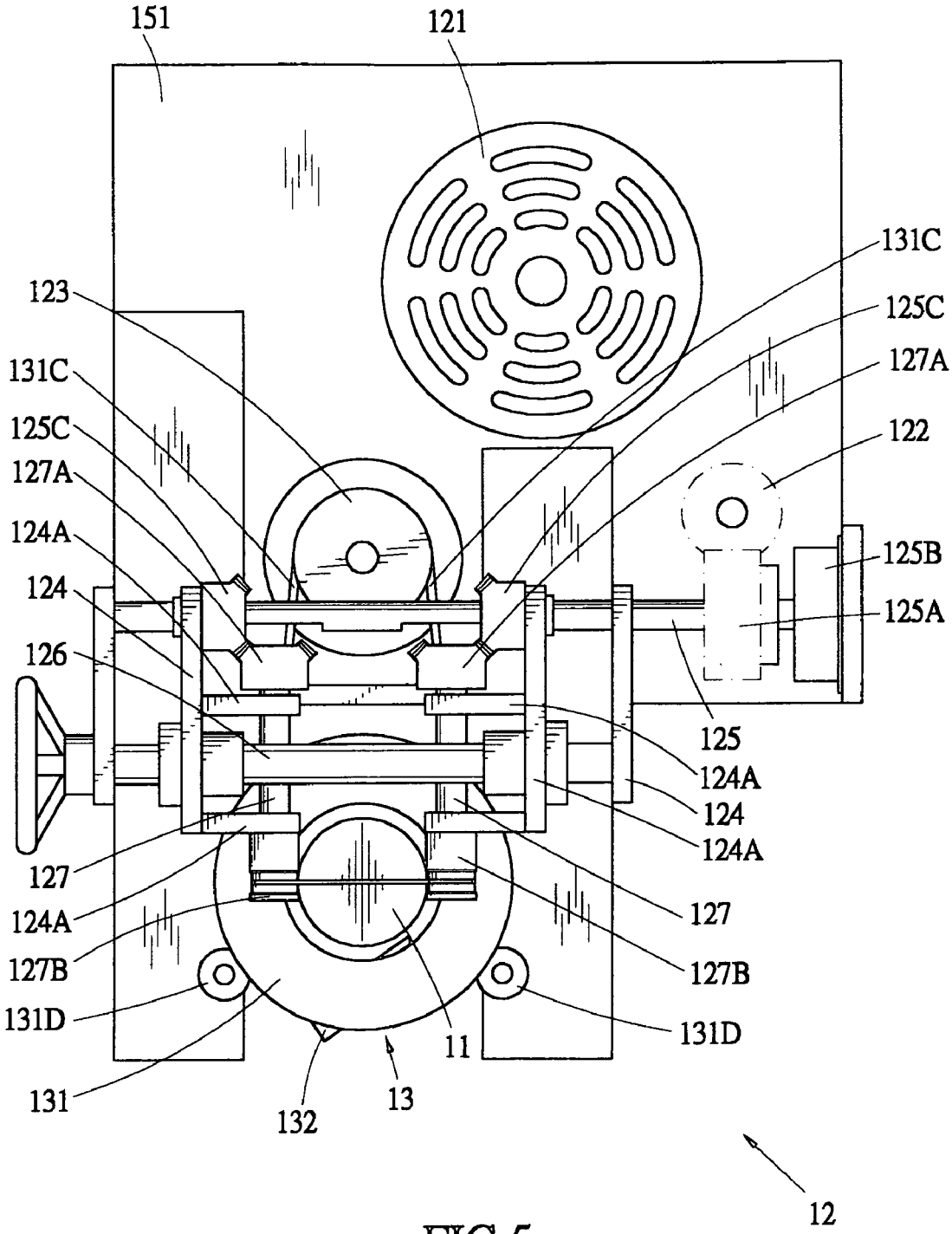
FIG. 5 is a top view of the filming fitting mechanism of the packaging device of the present invention.

Also referring to FIGS. 3–5, the film cylinder 11 of the film fitting mechanism 10 is arranged on a center portion of a bottom 151 of the casing 15. In operation, a length of tubular packaging film 300 is fit over the film cylinder 11, either manually or by an automatic film supply device (not shown).

The film feeding device 12 comprises a motor 121, a worm 122, a clutch 123, a pair of retention blocks 124, a shaft 125, a retention bar 126, and roller axles 127. The motor 121, such as an electric motor, the worm 122, and the clutch 123 constitute a power generation system, in which the worm 122 and the clutch 123 are driven by the motor 121 to separately supply mechanical power from the motor 121 to the moving parts of the packaging device 100. The coupling between the motor 121 and the worm 122 and the clutch 123 can be of any known devices, such as a gear system and a belt based transmission system.

The retention blocks 124 are arranged on opposite sides of the bottom 151 of the casing 15. The shaft 125 and the retention bar 126 extend, in parallel to each other, between the retention blocks 124 and rotatably supported thereby. The shaft 125 has an inner end, substantially located between the retention blocks 124, to which two first bevel gears 125C are mounted, and an outer end extending beyond one of the retention blocks 124 with a worm gear 125A mounted thereon. The worm gear 125A mates the worm 122 of the power generation system thereby allowing mechanical power to be transmitted from the motor 121 to the shaft 125. The outer end of the shaft 125 is supported by a bearing 125B fixed to the casing 15.

Upper and lower pairs of lug 124A are formed on each retention block 124 and spaced from each other in a vertical direction. Each lug pair comprises two lugs 124A aligned in a front-rear direction to support a roller axle 127. Each roller axle 127 has an outer end extending beyond the lug 124A to support a roller 127B that is engageable with the film cylinder 11. The roller axle 127 associated with each lower pair of lugs 124A has an inner end extending beyond another lug 124A to support a second bevel gear 127A that mates each first bevel gear 125C thereby transmitting the mechanical power to the rollers 127B.

With the tubular heat shrinking film 300 fit over the film cylinder 11 and the rollers 127 engaging the film cylinder 11 to tightly interpose the film 300 between the rollers 127 and the film cylinder 11, the rotation of the lower rollers 127B that is driven by the bevel gears 125C, 127A causes the film 300 to slide along the film cylinder 11 in a downward direction. The upper rollers 127 help guide the movement of the film 300 along the film cylinder 11.

The film cutting device 13 is arranged in a front portion of the casing 15, comprising a rotating disc 131 and a plurality of cutters 132. The rotating disc 131 forms a central bore 131A through which a lower section of the film cylinder 11 extends. A coupling portion 131B is formed on an underside of the rotating disc 131 and is coupled to the clutch 123 by a belt 131C whereby mechanical power is transmitted from the motor 121 to the rotating disc 131 and thus rotating the disc 131 about the film cylinder 11. Idle rollers 131A are provided on the casing 15 to engage the coupling portion 131B and thus guide the rotation of the disc 131.

Each cutter 132 is pivoted to the underside of the disc 131 whereby when the disc 131 rotates, the cutter 132 is forced toward the film 300 fit over the film cylinder 11 by the centrifugal force acting on the cutter 132 and thereby cutting through the film 300. In practice, the cutting operation is performed only after the film 300 is driven downward a predetermined distance by the rollers 127 of the film feeding device 12 and thus the film 300 can be cut off at any desired length.

The film discharge device 14 includes a motor 141 and a roller 142. The motor 141 is mounted to the casing 15 and comprises a spindle 141A having an end located below the lower section of the film cylinder 11. The roller 142 is mounted to the end of the spindle 141A and physically engaging the film 300 fit over the film cylinder 11. The roller 142 is driven by the spindle 141A to move the predetermined length of the film 300 that is cut off by the cutters 132 in a downward direction toward a product to be packed.

Although the fitting mechanism 11 has been described with great detail, it is apparent to those having ordinary skills to replace one or more parts of the fitting mechanism 11 just described. Thus, the above described structure of the fitting mechanism 11 is only a preferred embodiment of the present invention and can be replaced by any equivalent mechanisms, within the scope of the present invention defined in the appended claims, that are capable to feed, cut and discharge a packaging film 300.

The film shrinking mechanism 20 is arranged below the film fitting mechanism 11, comprising a base 21 and at least one pair of hot air supply units 22. The base 21 is located substantially below the film cylinder 11 of the film fitting mechanism 10 to support a product 200 to be packed thereon whereby the length of the film 300 cut off by the cutters 132 is supplied by the film discharge device 14 toward and fitting over the product 200. The hot air supply units 22 can be of any known devices that heat and conduct air streams toward the product 200 and thus induce shrinkage of the film 300 around the product 200 due to the high temperature of the heated air streams. The heated air streams are started and guided toward the product 200 only after the cut film 300 is fit over the product 200 in order to ensure packaging quality.

The controller 30 is provided to control the operation of the packaging device 100, including film feeding, film cutting, discharge and fitting the film 300 over the product 200, and heating and thus shrinking the film 300. The controller 30 comprises a keypad 31 comprised of a number of operation keys, a control knob or pushbutton 32, and indicators 33, which allow for entry of instruction, starting/stopping the operation and display operation conditions to the operator.

Figure 6:
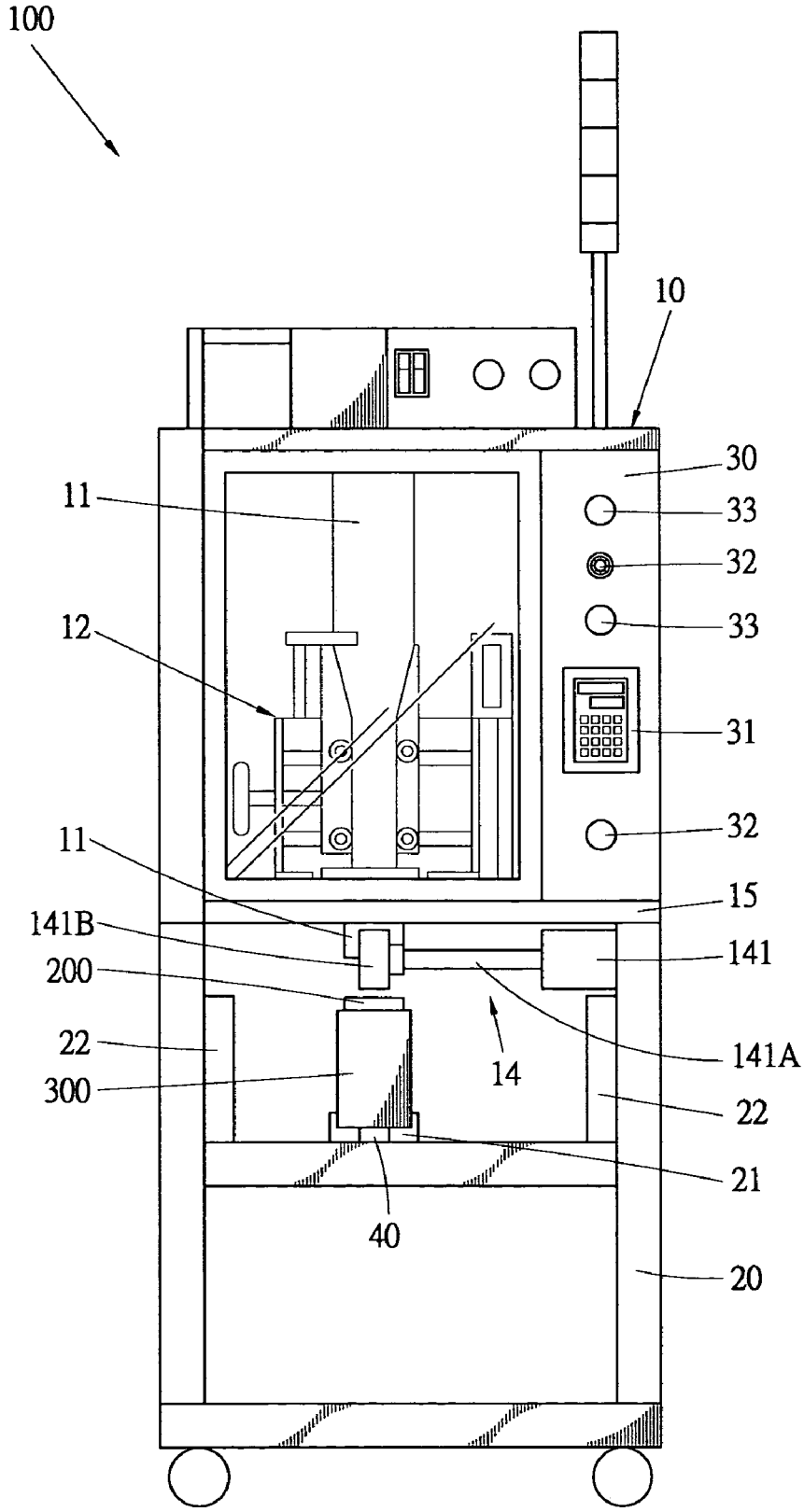
FIG. 6 is a front view of a packaging device constructed in accordance with a second embodiment of the present invention.

Also referring to FIG. 6, a second embodiment of the packaging device in accordance with the present invention is shown, also designated with reference numeral 100 for simplicity. The packaging device 100 of the second embodiment comprises a sensor 40 arranged on the base 21 of the film shrinking mechanism 20 to detect if the product 200 to be packed is properly placed on the base 21. The sensor 40 can be of any known type, such as photoelectrical sensor and micro-switch. Based on the detection, the sensor 40 issues a signal to the controller 30, which in turn starts the operation of the film fitting mechanism 10 and the film shrinking mechanism 20 when the product 200 is properly placed on the base 21. This ensures operation safety of the packaging device 100.

Figure 7:
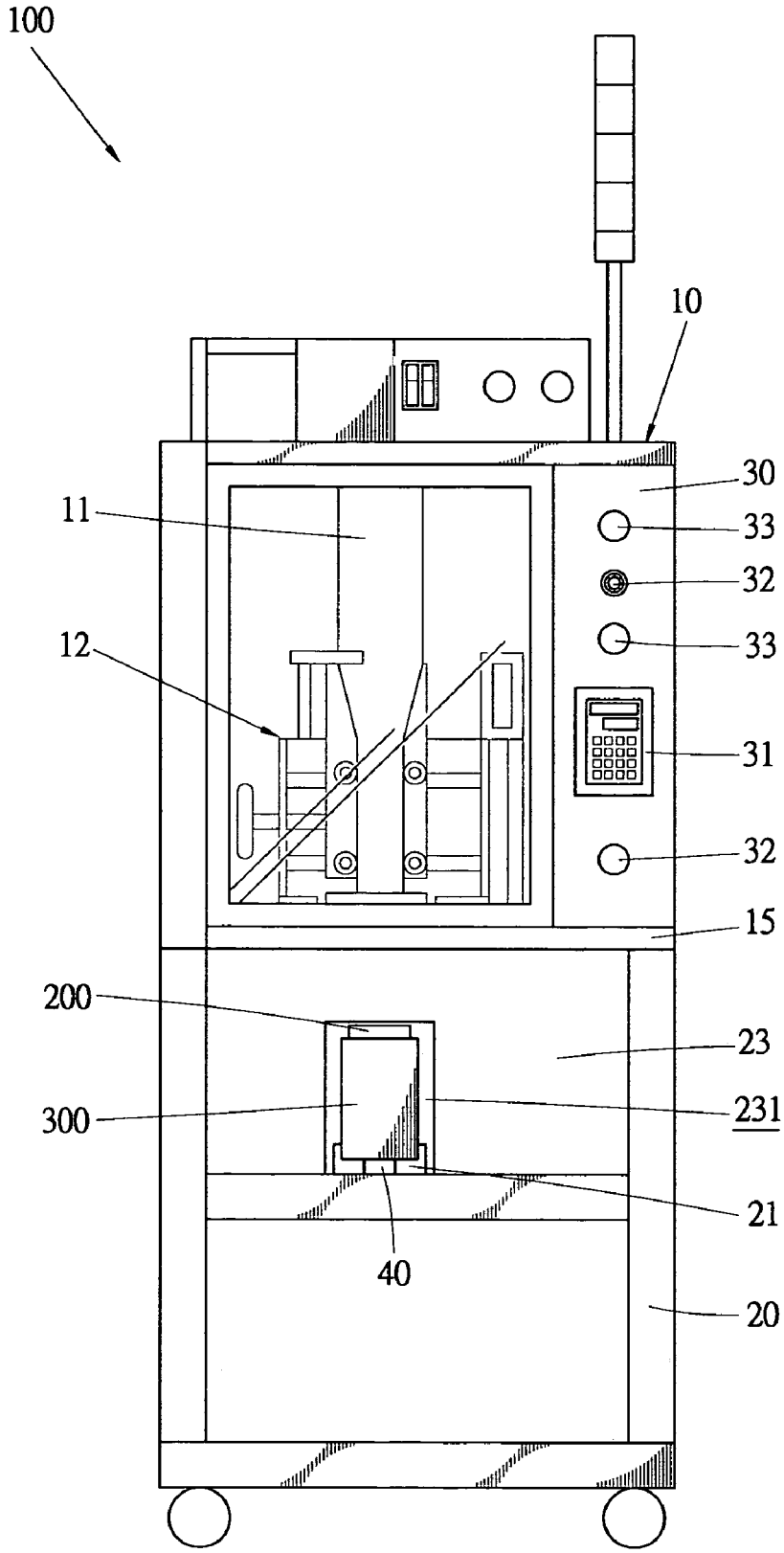
FIG. 7 is a front view of a packaging device constructed in accordance with a third embodiment of the present invention.

Also referring to FIG. 7, a third embodiment of the packaging device in accordance with the present invention is shown, also designated with reference numeral 100 for simplicity. The packaging device 100 of the third embodiment comprises a front panel 23 mounted in the front side of the film shrinking mechanism 20. An opening 231 is formed on the panel 23, at a position corresponding to the base 21 and the product 200 placed on the base 21, in order to provide easy visual inspection and access of the product 200 y the operator. The panel 23 helps concentrating the heated air around the product 200 to be packed and thus enhancing the operation efficiency of film shrinking.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A packaging device comprising:

a film fitting mechanism comprising:

a film cylinder extending in a predetermined direction and adapted to allow a heat-shrinking film to movably fit thereover, a film feeding device adapted to engage and move the film a predetermined distance in the predetermined direction along the film cylinder, the film feeding device including:

a) a motor adapted to generate mechanical power, b) a worm and a clutch respectively coupled to and driven by the mechanical power of the motor, c) two retention blocks spaced from each other and each forming lugs, d) a shaft rotatably supported by the retention blocks with a first end located between the retention blocks and a second end extending outside one of the retention blocks, at least one first bevel gear being mounted to the first end of the shaft, a worm gear being mounted to the second end of the shaft and engaging and driven by the worm, e) a retention bar rotatable supported by the retention blocks and substantially parallel to the shaft, and, f) roller axles rotatable mounted to the lugs to each support a roller engaging the film fit over the film cylinder, at least one of the roller axles comprising a second bevel gear mating and driven by the first bevel gear to move the film along the film cylinder, a film cutting device adapted to cut off a length of the film corresponding to the predetermined distance that the film is moved by the film feeding device, and a film discharge device adapted to convey the length of the film that is cut off by the film cutting device toward an article to be packed by the film;

a film shrinking mechanism located next to the film fitting mechanism in the predetermined direction, the film shrinking mechanism comprising:

a base substantially corresponding in position to the film cylinder and adapted to support the article to be packed thereon in such a way to allow the length of the film conveyed by the film discharge device to fit over the article, and at least a pair of hot air supply units supplying air stream of high temperature toward the article over which the film fits thereby heating and thus shrinking the film to tightly engage the article; and a controller controlling and coordinating the operation of the film fitting mechanism and the film shrinking mechanism.

2. The packaging device as claimed in claim 1, wherein the film fitting mechanism comprises a casing in which the film cylinder, the film feeding device and the film cutting device are accommodated.

3. The packaging device as claimed in claim 1, wherein the film cutting device comprises a rotating disc forming a central bore through which an end section of the film cylinder extends toward the base of the film shrinking device and a plurality of cutters pivotally mounted to the disc.

4. The packaging device as claimed in claim 3, wherein the disc forms a coupling portion mechanically coupling with the clutch to transmit the mechanical power to the disc.

5. The packaging device as claimed in claim 1, wherein the film discharge device comprises a motor having a spindle and a roller mounted to the spindle for driving the length of the film toward the article to be packed.

6. The packaging device as claimed in claim 1 further comprising a sensor mounted to the base.

7. The packaging device as claimed in claim 1, wherein the film shrinking mechanism is accommodating in a space defined by a front panel in which an opening is formed for access of the article to be packed.

8. The packaging device as claimed in claim 1, wherein the hot air supply units comprises means for generation of airflow and means for heating the airflow.

9. The packaging device as claimed in claim 1, wherein the controller comprises a keypad, a knob and indicators.

* * * * *